US011011099B2

(12) United States Patent
Nakai

(10) Patent No.: US 11,011,099 B2
(45) Date of Patent: May 18, 2021

(54) DRIVING CIRCUIT AND DISPLAY DEVICE

(71) Applicant: SHENZHEN TOREY MICROELECTRONIC TECHNOLOGY CO. LTD., Shenzhen (CN)

(72) Inventor: Takahiro Nakai, Sakai (JP)

(73) Assignee: SHENZHEN TOREY MICROELECTRONIC TECHNOLOGY CO. LTD., Shenzhen (CN)

( * ) Notice: Subject to any disclaimer, the term of this patent is extended or adjusted under 35 U.S.C. 154(b) by 0 days.

(21) Appl. No.: 16/741,143

(22) Filed: Jan. 13, 2020

(65) Prior Publication Data

US 2020/0226970 A1 Jul. 16, 2020

Related U.S. Application Data

(60) Provisional application No. 62/792,715, filed on Jan. 15, 2019.

(51) Int. Cl.
*G09G 3/20* (2006.01)

(52) U.S. Cl.
CPC ... *G09G 3/2007* (2013.01); *G09G 2320/0233* (2013.01)

(58) Field of Classification Search
CPC .. G09G 3/2007; G09G 3/3275; G09G 3/3685; G09G 3/3688; G09G 3/3692; G09G 3/3696; G09G 2320/02; G09G 2320/0233; G09G 2320/0242; G09G 2320/0252; G09G 2320/0271; G09G 2320/0276; G09G 2310/027; G09G 2310/0272; G09G 2310/0275
USPC ..... 345/690
See application file for complete search history.

(56) References Cited

U.S. PATENT DOCUMENTS 6,750,839 B1 * 6/2004 Hogan ..... G09G 3/3688 345/89
2002/0033763 A1 * 3/2002 Nakao ..... H03M 1/682 341/154
2004/0233226 A1 * 11/2004 Toriumi ..... G09G 3/3648 345/690
2005/0001858 A1 * 1/2005 Morita ..... G09G 3/3685 345/690
2005/0062734 A1 * 3/2005 Morita ..... G09G 3/3688 345/204

(Continued)

FOREIGN PATENT DOCUMENTS

JP 3594125 B2 11/2004

*Primary Examiner* — Tom V Sheng
(74) *Attorney, Agent, or Firm* — ScienBiziP, P.C.

(57) ABSTRACT

A DA converter is provided with a select circuit that selects a predetermined number of gray scale reference voltages from a plurality of different gray scale reference voltages on a basis of display data corresponding to a plurality of different gray scale values, and an output circuit that outputs an output voltage corresponding to the gray scale values on a basis of the gray scale reference voltages selected by the select circuit. When the gray scale reference voltages corresponding to the selected gray scale values are substantially equal to the output voltage, the select circuit selects the gray scale reference voltages such that at least one of the gray scale reference voltages to be selected is different from the others.

5 Claims, 13 Drawing Sheets

| GRAY LEVEL | BIT | | | | | | IN3 | IN2 | IN1 | Vout = (VIN3 + VIN2 + VIN1 × 2)/4 |
|---|---|---|---|---|---|---|---|---|---|---|
| | 5 | 4 | 3 | 2 | 1 | 0 | | | | |
| 0 | 0 | 0 | 0 | 0 | 0 | 0 | V0B | V0B | V0A | (V0A + V0A + V0B × 2)/4 |
| 1 | 0 | 0 | 0 | 0 | 0 | 1 | V0 | V4 | V0 | (V0 + V4 + V0 × 2)/4 |
| 2 | 0 | 0 | 0 | 0 | 1 | 0 | V0 | V0 | V4 | (V0 + V0 + V4 × 2)/4 |
| 3 | 0 | 0 | 0 | 0 | 1 | 1 | V0 | V4 | V4 | (V0 + V4 + V4 × 2)/4 |
| 4 | 0 | 0 | 0 | 1 | 0 | 0 | V0 | V0 | V8 | (V0 + V0 + V8 × 2)/4 |
| 5 | 0 | 0 | 0 | 1 | 0 | 1 | V4 | V8 | V4 | (V4 + V8 + V4 × 2)/4 |
| 6 | 0 | 0 | 0 | 1 | 1 | 0 | V4 | V4 | V8 | (V4 + V4 + V8 × 2)/4 |
| 7 | 0 | 0 | 0 | 1 | 1 | 1 | V4 | V8 | V8 | (V4 + V8 + V8 × 2)/4 |
| 8 | 0 | 0 | 1 | 0 | 0 | 0 | V4 | V4 | V12 | (V4 + V4 + V12 × 2)/4 |
| ... | ... | ... | ... | ... | ... | ... | ... | ... | ... | ... |
| 59 | 1 | 1 | 1 | 0 | 1 | 1 | V56 | V60 | V60 | (V56 + V60 + V60 × 2)/4 |
| 60 | 1 | 1 | 1 | 1 | 0 | 0 | V56 | V56 | V64 | (V56 + V56 + V64 × 2)/4 |
| 61 | 1 | 1 | 1 | 1 | 0 | 1 | V60 | V64 | V60 | (V60 + V64 + V60 × 2)/4 |
| 62 | 1 | 1 | 1 | 1 | 1 | 0 | V60 | V60 | V64 | (V60 + V60 + V64 × 2)/4 |
| 63 | 1 | 1 | 1 | 1 | 1 | 1 | V60 | V64 | V64 | (V60 + V64 + V64 × 2)/4 |

(56) References Cited

U.S. PATENT DOCUMENTS

| | | | | |
|---|---|---|---|---|
| 2005/0207249 | A1* | 9/2005 | Morita | G09G 3/3233 365/203 |
| 2009/0066681 | A1* | 3/2009 | Kim | H03M 1/68 345/210 |
| 2009/0295838 | A1* | 12/2009 | Tanigawa | G09G 3/3688 345/690 |
| 2010/0013749 | A1* | 1/2010 | Huang | G09G 3/3688 345/89 |
| 2011/0227647 | A1* | 9/2011 | Fujiwara | G09G 3/3688 330/253 |
| 2014/0176622 | A1* | 6/2014 | Jung | G09G 3/3208 345/690 |
| 2017/0169755 | A1* | 6/2017 | Tamura | G09G 3/2092 |
| 2019/0385505 | A1* | 12/2019 | Nakai | G09G 3/20 |

* cited by examiner $Vout = (V0 \times 2 + V8 \times 2)/4 \approx V4$ $Vout = (V4 \times 3 + V8)/4 \approx V5$ $Vout = (V4 \times 2 + V8 \times 2)/4 \approx V6$ $Vout = (V4 + V8 \times 3)/4 \approx V7$

FIG. 6

| GRAY LEVEL | BIT | | | | | | IN3 | IN2 | IN1 | Vout = (VIN3 + VIN2 + VIN1 × 2)/4 |
|---|---|---|---|---|---|---|---|---|---|---|
| | 5 | 4 | 3 | 2 | 1 | 0 | | | | |
| 0 | 0 | 0 | 0 | 0 | 0 | 0 | V0B | V0B | V0A | (V0A + V0A + V0B × 2)/4 |
| 1 | 0 | 0 | 0 | 0 | 0 | 1 | V0 | V4 | V0 | (V0 + V4 + V0 × 2)/4 |
| 2 | 0 | 0 | 0 | 0 | 1 | 0 | V0 | V0 | V4 | (V0 + V0 + V4 × 2)/4 |
| 3 | 0 | 0 | 0 | 0 | 1 | 1 | V0 | V4 | V4 | (V0 + V4 + V4 × 2)/4 |
| 4 | 0 | 0 | 0 | 1 | 0 | 0 | V0 | V0 | V8 | (V0 + V0 + V8 × 2)/4 |
| 5 | 0 | 0 | 0 | 1 | 0 | 1 | V4 | V8 | V4 | (V4 + V8 + V4 × 2)/4 |
| 6 | 0 | 0 | 0 | 1 | 1 | 0 | V4 | V4 | V8 | (V4 + V4 + V8 × 2)/4 |
| 7 | 0 | 0 | 0 | 1 | 1 | 1 | V4 | V8 | V8 | (V4 + V8 + V8 × 2)/4 |
| 8 | 0 | 0 | 1 | 0 | 0 | 0 | V4 | V4 | V12 | (V4 + V4 + V12 × 2)/4 |
| ··· | ··· | ··· | ··· | ··· | ··· | ··· | ··· | ··· | ··· | ··· |
| 59 | 1 | 1 | 1 | 0 | 1 | 1 | V56 | V60 | V60 | (V56 + V60 + V60 × 2)/4 |
| 60 | 1 | 1 | 1 | 1 | 0 | 0 | V56 | V56 | V64 | (V56 + V56 + V64 × 2)/4 |
| 61 | 1 | 1 | 1 | 1 | 0 | 1 | V60 | V64 | V60 | (V60 + V64 + V60 × 2)/4 |
| 62 | 1 | 1 | 1 | 1 | 1 | 0 | V60 | V60 | V64 | (V60 + V60 + V64 × 2)/4 |
| 63 | 1 | 1 | 1 | 1 | 1 | 1 | V60 | V64 | V64 | (V60 + V64 + V64 × 2)/4 |

FIG. 8

| GRAY LEVEL | BIT | | | | | | IN3 | IN2 | IN1 | Vout = (VIN3 + VIN2 + VIN1 x 2)/4 |
|---|---|---|---|---|---|---|---|---|---|---|
| | 5 | 4 | 3 | 2 | 1 | 0 | | | | |
| 0 | 0 | 0 | 0 | 0 | 0 | 0 | V0B | V0B | V0A | (V0B + V0B + V0A x 2)/4 |
| 1 | 0 | 0 | 0 | 0 | 0 | 1 | V1B | V1A | V1B | (V1B + V1A + V1B x 2)/4 |
| 2 | 0 | 0 | 0 | 0 | 1 | 0 | V2B | V2B | V2A | (V2B + V2B + V2A x 2)/4 |
| 3 | 0 | 0 | 0 | 0 | 1 | 1 | V3B | V3A | V3A | (V3B + V3A + V3A x 2)/4 |
| 4 | 0 | 0 | 0 | 1 | 0 | 0 | V4B | V4B | V4A | (V4B + V4B + V4A x 2)/4 |
| 5 | 0 | 0 | 0 | 1 | 0 | 1 | V4A | V8 | V4A | (V4A + V8 + V4A x 2)/4 |
| 6 | 0 | 0 | 0 | 1 | 1 | 0 | V4A | V4A | V8 | (V4A + V4A + V8 x 2)/4 |
| 7 | 0 | 0 | 0 | 1 | 1 | 1 | V4A | V8 | V8 | (V4A + V8 + V8 x 2)/4 |
| 8 | 0 | 0 | 1 | 0 | 0 | 0 | V4A | V4A | V12 | (V4A + V4A + V12 x 2)/4 |
| 9 | 0 | 0 | 1 | 0 | 0 | 1 | V8 | V12 | V8 | (V8 + V12 + V8 x 2)/4 |
| 10 | 0 | 0 | 1 | 0 | 1 | 0 | V8 | V8 | V12 | (V8 + V8 + V12 x 2)/4 |
| 11 | 0 | 0 | 1 | 0 | 1 | 1 | V8 | V12 | V12 | (V8 + V12 + V12 x 2)/4 |
| 12 | 0 | 0 | 1 | 1 | 0 | 0 | V8 | V8 | V16 | (V8 + V8 + V16 x 2)/4 |
| ... | ... | ... | ... | ... | ... | ... | ... | ... | ... | ... |
| 59 | 1 | 1 | 1 | 0 | 1 | 1 | V56 | V60 | V60 | (V56 + V60 + V60 x 2)/4 |
| 60 | 1 | 1 | 1 | 1 | 0 | 0 | V56 | V56 | V64 | (V56 + V56 + V64 x 2)/4 |
| 61 | 1 | 1 | 1 | 1 | 0 | 1 | V60 | V64 | V60 | (V60 + V64 + V60 x 2)/4 |
| 62 | 1 | 1 | 1 | 1 | 1 | 0 | V60 | V60 | V64 | (V60 + V60 + V64 x 2)/4 |
| 63 | 1 | 1 | 1 | 1 | 1 | 1 | V60 | V64 | V64 | (V60 + V64 + V64 x 2)/4 |

FIG. 9

| GRAY LEVEL | BIT | | | | | | IN3 | IN2 | IN1 | Vout = (VIN3 + VIN2 + VIN1 x 2)/4 |
|---|---|---|---|---|---|---|---|---|---|---|
| | 5 | 4 | 3 | 2 | 1 | 0 | | | | |
| 0 | 0 | 0 | 0 | 0 | 0 | 0 | V0 | V0 | V0 | V0 |
| 1 | 0 | 0 | 0 | 0 | 0 | 1 | V1 | V1 | V1 | V1 |
| 2 | 0 | 0 | 0 | 0 | 1 | 0 | V2 | V2 | V2 | V2 |
| 3 | 0 | 0 | 0 | 0 | 1 | 1 | V3 | V3 | V3 | V3 |
| 4 | 0 | 0 | 0 | 1 | 0 | 0 | V4 | V4 | V4 | V4 |
| 5 | 0 | 0 | 0 | 1 | 0 | 1 | V4 | V8 | V4 | (V4 + V8 + V4 x 2)/4 |
| 6 | 0 | 0 | 0 | 1 | 1 | 0 | V4 | V4 | V8 | (V4 + V4 + V8 x 2)/4 |
| 7 | 0 | 0 | 0 | 1 | 1 | 1 | V4 | V8 | V8 | (V4 + V8 + V8 x 2)/4 |
| 8 | 0 | 0 | 1 | 0 | 0 | 0 | V8 | V8 | V8 | V8 |
| 9 | 0 | 0 | 1 | 0 | 0 | 1 | V8 | V12 | V8 | (V8 + V12 + V8 x 2)/4 |
| 10 | 0 | 0 | 1 | 0 | 1 | 0 | V8 | V8 | V12 | (V8 + V8 + V12 x 2)/4 |
| 11 | 0 | 0 | 1 | 0 | 1 | 1 | V8 | V12 | V12 | (V8 + V12 + V12 x 2)/4 |
| 12 | 0 | 0 | 1 | 1 | 0 | 0 | V12 | V12 | V12 | V12 |
| ... | ... | ... | ... | ... | ... | ... | ... | ... | ... | ... |
| 59 | 1 | 1 | 1 | 0 | 1 | 1 | V56 | V60 | V60 | (V56 + V60 + V60 x 2)/4 |
| 60 | 1 | 1 | 1 | 1 | 0 | 0 | V60 | V60 | V60 | V60 |
| 61 | 1 | 1 | 1 | 1 | 0 | 1 | V60 | V64 | V60 | (V60 + V64 + V60 x 2)/4 |
| 62 | 1 | 1 | 1 | 1 | 1 | 0 | V60 | V60 | V64 | (V60 + V60 + V64 x 2)/4 |
| 63 | 1 | 1 | 1 | 1 | 1 | 1 | V60 | V64 | V64 | (V60 + V64 + V64 x 2)/4 |

FIG. 13

| GRAY LEVEL | BIT | | | | | | IN3 | IN2 | IN1 | Vout = (VIN3 + VIN2 + VIN1 × 2)/4 |
|---|---|---|---|---|---|---|---|---|---|---|
| | 5 | 4 | 3 | 2 | 1 | 0 | | | | |
| 0 | 0 | 0 | 0 | 0 | 0 | 0 | V0 | V0 | V0 | V0 |
| 1 | 0 | 0 | 0 | 0 | 0 | 1 | V0 | V4 | V0 | (V0 + V4 + V0 × 2)/4 |
| 2 | 0 | 0 | 0 | 0 | 1 | 0 | V0 | V0 | V4 | (V0 + V0 + V4 × 2)/4 |
| 3 | 0 | 0 | 0 | 0 | 1 | 1 | V0 | V4 | V4 | (V0 + V4 + V4 × 2)/4 |
| 4 | 0 | 0 | 0 | 1 | 0 | 0 | V4 | V4 | V4 | V4 |
| 5 | 0 | 0 | 0 | 1 | 0 | 1 | V4 | V8 | V4 | (V4 + V8 + V4 × 2)/4 |
| 6 | 0 | 0 | 0 | 1 | 1 | 0 | V4 | V4 | V8 | (V4 + V4 + V8 × 2)/4 |
| 7 | 0 | 0 | 0 | 1 | 1 | 1 | V4 | V8 | V8 | (V4 + V8 + V8 × 2)/4 |
| 8 | 0 | 0 | 1 | 0 | 0 | 0 | V8 | V8 | V8 | V8 |
| ··· | ··· | ··· | ··· | ··· | ··· | ··· | ··· | ··· | ··· | ··· |
| 59 | 1 | 1 | 1 | 0 | 1 | 1 | V56 | V60 | V60 | (V56 + V60 + V60 × 2)/4 |
| 60 | 1 | 1 | 1 | 1 | 0 | 0 | V60 | V60 | V60 | V60 |
| 61 | 1 | 1 | 1 | 1 | 0 | 1 | V60 | V64 | V60 | (V60 + V64 + V60 × 2)/4 |
| 62 | 1 | 1 | 1 | 1 | 1 | 0 | V60 | V60 | V64 | (V60 + V60 + V64 × 2)/4 |
| 63 | 1 | 1 | 1 | 1 | 1 | 1 | V60 | V64 | V64 | (V60 + V64 + V64 × 2)/4 |

Vout = V4

Vout = (V4 x 3 + V8) / 4 ≈ V5

Vout = (V4 x 2 + V8 x 2) / 4 ≈ V6

Vout = (V4 + V8 x 3) / 4 ≈ V7

DRIVING CIRCUIT AND DISPLAY DEVICE

BACKGROUND

1. Field

The present disclosure relates to a driving circuit that drives a display panel and a display device provided with the driving circuit.

2. Description of the Related Art

Display driver ICs (driving circuits) for panels such as liquid crystal display panels and organic electroluminescence (EL) panels provided with organic light-emitting diodes (OLEDs) need to be even faster with less output delay to accommodate higher-definition panels and features such as double refresh rate modes in recent panels.

FIG. 10A is a diagram illustrating a source driving circuit of the related art. FIG. 10B is a circuit diagram illustrating a configuration of a select circuit 22 and gamma circuits 24 in the source driving circuit.

As illustrated in FIG. 10A, the source driving circuit of the related art includes a DA converter 23, the gamma circuits 24, and a demultiplexer 25. The source driving circuit drives a plurality of source lines S1, . . . , Sr by time-division multiplexing.

The gamma circuits 24 supply 256 gray scale reference voltages V0 to V255 to the DA converter 23 through 256 reference voltage bus lines, respectively. Note that in the description herein, the "gray scale reference voltages" are referred to as "reference voltages" for simplicity.

The DA converter 23 includes the select circuit 22 and a plurality of source amplifiers AM1 to AM171. On the basis of each of the gray scale values of input image data D1 to D171, the select circuit 22 selects one of the reference voltages V0 to V255 supplied from the gamma circuit 24, and supplies the selected reference voltage to each of the source amplifiers AM1 to AM171.

The demultiplexer 25 distributes voltages output from each output node Q1 to Q171 of the source amplifiers AM1 to AM171 to source lines S1 to S3078 by time division on the basis of select signals SEL1 to SEL18.

FIG. 10B illustrates an exemplary configuration of the DA converter 23 and the gamma circuits 24. To output the reference voltages V0 to V255, the gamma circuits 24 disposed on the left and right sides of the select circuit 22 include resistive elements RA1 to RA257 and resistive elements RB1 to RB257 that divide the voltage into a high-potential voltage VH and a low-potential VL. Nodes between the resistive elements RA1 to RA257 and nodes between the resistive elements RB1 to RB257 are connected to common reference voltage bus lines BL1 to BL256. Additionally, the reference voltages V0 to V255 are output to each of the reference voltage bus lines BL1 to BL256.

The select circuit 22 includes switches S1-1 to S171-256 connected between each of the plurality of source amplifiers AM1 to AM171 and each of the reference voltage bus lines BL1 to BL256. Each of the switches S1-1 to S171-256 is controlled on and off on the basis of each of the gray scale values of the image data D1 to D171. For example, in the case where the image data D171 has gray level 127 (corresponding to the reference voltage V127), only the switch S171-128 is turned on, while the other switches S171-1 to S171-127 and S171-129 to S171-256 are turned off. With this arrangement, the reference voltage V127 is supplied to an input node U171 of the source amplifier AM171.

FIGS. 11A to 11C are diagrams for explaining a problem with the source driving circuit illustrated in FIG. 10A. FIG. 12 is a diagram for explaining a case where the above problem occurs conspicuously in the source driving circuit of the related art.

In the case of a source driving circuit 100 of the related art illustrated in FIG. 12, for example, in the case where the gray scale values of each of the image data D1 to Dn are all one gray level (corresponding to the reference voltage V1), all input nodes U1 to Un of n source amplifiers AM1 to AMn are electrically connected to the reference voltage bus line BL2 to which the reference voltage V1 is output.

FIG. 11A is a diagram illustrating a schematic configuration of the source amplifier AMn. The input node Un and the output node Qn of the source amplifier AMn are connected to the gates of an input transistor Mp and an output transistor Mm, which are internal transistors of the source amplifier AMn. With this arrangement, the gate capacitance (illustrated by the dashed line in the diagram) of the input transistor Mp and the gate capacitance (illustrated by the dashed line in the diagram) of the output transistor Mm are formed.

As illustrated in FIG. 12, all of the input nodes U1 to Un of the n source amplifiers AM1 to AMn are electrically connected to one of the reference voltage bus lines BL1 to BL256 that respectively output the reference voltages V0 to V255. In the example illustrated in FIG. 12, the input nodes U1 to Un are connected to the reference voltage bus line BL2.

In such a case, the influence of the above gate capacitances causes the load on the specific reference voltage bus line (in the example of FIG. 12, the reference voltage bus line BL2) to increase. In other words, as more input nodes U1 to Un of the source amplifiers AM1 to AMn are electrically connected to a certain one of the reference voltage bus line BL1 to BL256, the load on the certain one of the reference voltage bus lines BL1 to BL256 increases.

Also, as the difference between the gray scale values of the previously input image data D1 to Dn and the gray scale values of the currently input image data D1 to Dn becomes larger, the load on the certain one of the reference voltage bus lines BL1 to BL256 increases. For example, in the case where each of the image data D1 to Dn changes from gray level 0 (corresponding to the reference voltage V0) to gray level 255 (corresponding to the reference voltage V255), a phenomenon like the following occurs.

FIG. 11B is a diagram illustrating the variation in the output of the reference voltage bus line BL256 due the influence of the above gate capacitances in the case of maximum load on the reference voltage bus line BL256.

Like the case of V0>V255 illustrated in FIG. 11B, when each of the image data D1 to Dn changes from gray level 0 to gray level 255, the movement of charge stored in the gate capacitances causes the voltage of the reference voltage bus line BL256 to lift up in the direction of the arrow in the diagram, namely the V0 direction. In other words, when each of the image data D1 to Dn changes from gray level 0 to gray level 255, the voltage of the reference voltage bus line BL256 becomes higher than the expected value of V255.

Note that the amount by which the voltage is lifted increases with an increasing number of input nodes U1 to Un of the source amplifiers AM1 to AMn electrically connected to a certain one of the reference voltage bus lines BL1 to BL256.

FIG. 11C is a diagram illustrating the source output at each output node Qn of a plurality of source amplifiers AMn electrically connected to the reference voltage bus line BL256 in the case where the voltage of the reference voltage bus line BL256 lifts up as illustrated in FIG. 11B.

As illustrated in FIG. 11C, when each of the image data D1 to Dn changes from gray level 0 to gray level 255, the influence of the voltage lift described above increases the time it takes (settling time) until the source output changes from the V0 expected value corresponding to gray level 0 and stabilizes near the V255 expected value corresponding to gray level 255. In this way, in a display device provided with source driving circuit having a long settling time, problems such as insufficient display gray levels, display noise, or display unevenness may be visually perceived in some cases.

Also, Patent Literature 1 discloses a DA converter that generates some of the voltage levels demanded by the output voltage through interpolation, thereby greatly reducing the number of voltages produced by a reference voltage producing means compared to the number of demanded voltages. As an output circuit, the DA converter is provided with a source amplifier including a voltage follower circuit (see FIG. 2 of Patent Literature 1) with three input terminals.

To output an analog voltage, as illustrated in FIG. 13, if there are 64 gray levels for example, one of reference voltages V0, V4, V8, . . . , V60, V64 is selected and input into the source amplifier. The source amplifier includes input transistors in input terminals IN1 to IN3. In the example illustrated in FIG. 13, the input terminals IN2 and IN3 are weighted equally, while the weighting of the input terminal IN1 is double the weighting of the input terminals IN2 and IN3.

The DA converter provided with such a source amplifier is capable of outputting an analog voltage with 64 levels corresponding to 64 gray levels through the source amplifier, on the basis of 6-bit display data (containing 4-bit gray scale reference voltage select bits and 2-bit generated voltage select bits).

Meanwhile, in the above DA converter, the number of the three input terminals IN1 to IN3 of the source amplifier into which the reference voltage V0, V4, . . . , V64 is respectively input varies depending on the reference voltage V0, V4, . . . , V64 selected as the input voltage. Correspondingly, the gate capacitance of the input transistor connected to the reference voltage bus line that transmits the reference voltage V0, V4, . . . , V64 varies.

For example, as illustrated in FIGS. 13 and 14A, in the case of selecting gray level 4, the reference voltage V4 is input into all of the input terminals IN1 to IN3. In this case, the gate capacitance of each input transistor in the input terminals IN1 to IN3 of the source amplifier AM is connected to the reference voltage bus line of the reference voltage V4.

Herein, in FIGS. 14A to 14D, to express the weights of each of the input terminals IN1 to IN3 as 1, the source amplifier AM is illustrated as including two input terminals IN1 for the sake of convenience.

Also, as illustrated in FIGS. 13 and 14B, in the case of selecting gray level 5, the reference voltage V4×3 is input into the input terminals IN1 and IN3, and the reference voltage V8×1 is input into the input terminal IN2. In this case, the load on the reference voltage bus line of the reference voltage V4 becomes ¾ of the load when gray level 4 is selected.

Also, as illustrated in FIGS. 13 and 14C, in the case of selecting gray level 6, the reference voltage V4×2 is input into the input terminals IN1, and the reference voltage V8×2 is input into the input terminals IN2 and IN3. In this case, the load on the reference voltage bus line of the reference voltage V4 becomes ½ of the load when gray level 4 is selected.

Also, as illustrated in FIGS. 13 and 14D, in the case of selecting gray level 7, the reference voltage V4×1 is input into the input terminal IN3, and the reference voltage V8×3 is input into the input terminals IN1 and IN2. In this case, the load on the reference voltage bus line of the reference voltage V4 becomes ¼ of the load when gray level 4 is selected.

In this way, the number of plural source amplifiers connected at the same time to a certain reference voltage bus line does not change, but the number of input transistors connected at the same time increases. For this reason, the sudden potential variation that occurs when switching the gray level becomes larger. Also, because the number of input transistors into which the reference voltage is input changes, the magnitude of the sudden potential variation that occurs when switching the gray level varies depending on the gray level. Such differences in the magnitude of the potential variation depending on the gray level leads to inconsistencies in the settling time (stabilization time) of the output voltage of the source amplifier. Additionally, these inconsistencies may cause a display gray scale inversion to be visually perceived.

It is desirable to provide a driving circuit capable of achieving stable gray scale display.

SUMMARY

According to an aspect of the disclosure, there is provided a driving circuit provided with a select circuit that selects a predetermined number of gray scale reference voltages from a plurality of different gray scale reference voltages on a basis of display data corresponding to a plurality of different gray scale values, and an output circuit that outputs an output voltage corresponding to the gray scale values on a basis of the gray scale reference voltages selected by the select circuit. When the gray scale reference voltages corresponding to the selected gray scale values are substantially equal to the output voltage, the select circuit selects the gray scale reference voltages such that at least one of the gray scale reference voltages to be selected is different from the others.

According to another aspect of the disclosure, there is provided a display device provided with the driving circuit according to the above aspect and a display panel driven by the driving circuit.

BRIEF DESCRIPTION OF THE DRAWINGS

FIG. 6 is a table illustrating relationships of a gray scale value, display data, input terminals of the source amplifier, and an output voltage of the DA converter with regard to a digital-to-analog conversion performed by the DA converter;

FIG. 8 is a table illustrating relationships of a gray scale value, display data, input terminals of the source amplifier, and an output voltage of a DA converter with regard to a digital-to-analog conversion performed by the DA converter illustrated in FIG. 7;

FIG. 9 is a table illustrating relationships of a gray scale value, display data, input terminals of the source amplifier, and an output voltage of a DA converter with regard to a digital-to-analog conversion performed by a DA converter according to a comparative example of Embodiment 3;

FIG. 13 is a table illustrating relationships of a gray scale value, display data, input terminals of the source amplifier, and an output voltage of a DA converter with regard to a digital-to-analog conversion performed by a DA converter of the related art.

DESCRIPTION OF THE EMBODIMENTS

Display Device

A display device common to the embodiments of the present disclosure is described as follows on the basis of FIGS. 1 to 3.

Figure 1:
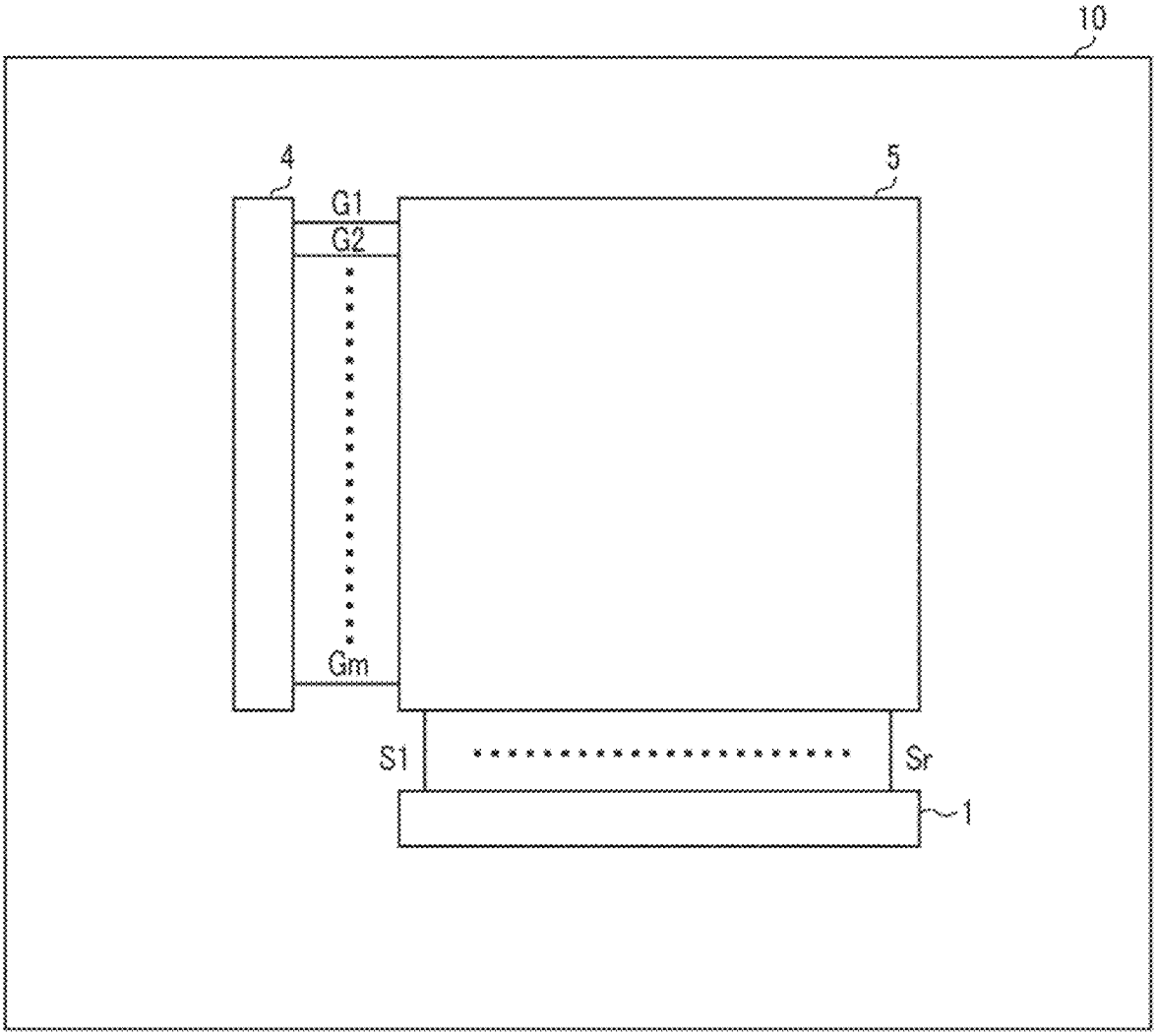
FIG. 1 is a diagram illustrating a configuration of a display device common to the embodiments.

FIG. 1 is a diagram illustrating a configuration of a display device 10 common to the embodiments. FIG. 2 is a block diagram illustrating a configuration of a source driving circuit 1 in the display device 10. FIG. 3 is a circuit diagram illustrating a source amplifier AM in the source driving circuit 1.

Configuration of Display Device 10

The display device 10 is provided with the source driving circuit 1 (driving circuit), a gate driving circuit 4, and a display panel 5. Output signals from the source driving circuit 1 are supplied to the display panel 5 through source lines S1 to Sr. Output signals from the gate driving circuit 4 are supplied to the display panel 5 through gate lines G1 to Gm. With this arrangement, the display panel 5 displays an image.

The display panel 5 may be a liquid crystal display panel or an organic electroluminescence (EL) display panel provided with organic light-emitting diodes (OLEDs), for example.

As described in Embodiments 1 to 3 described later, the display device 10 is provided with the source driving circuit 1 with a shortened output voltage settling time (stabilization time), and therefore is capable of reducing phenomena such as insufficient display gray levels, display noise, or display unevenness.

Configuration of Source Driving Circuit 1

Figure 2:
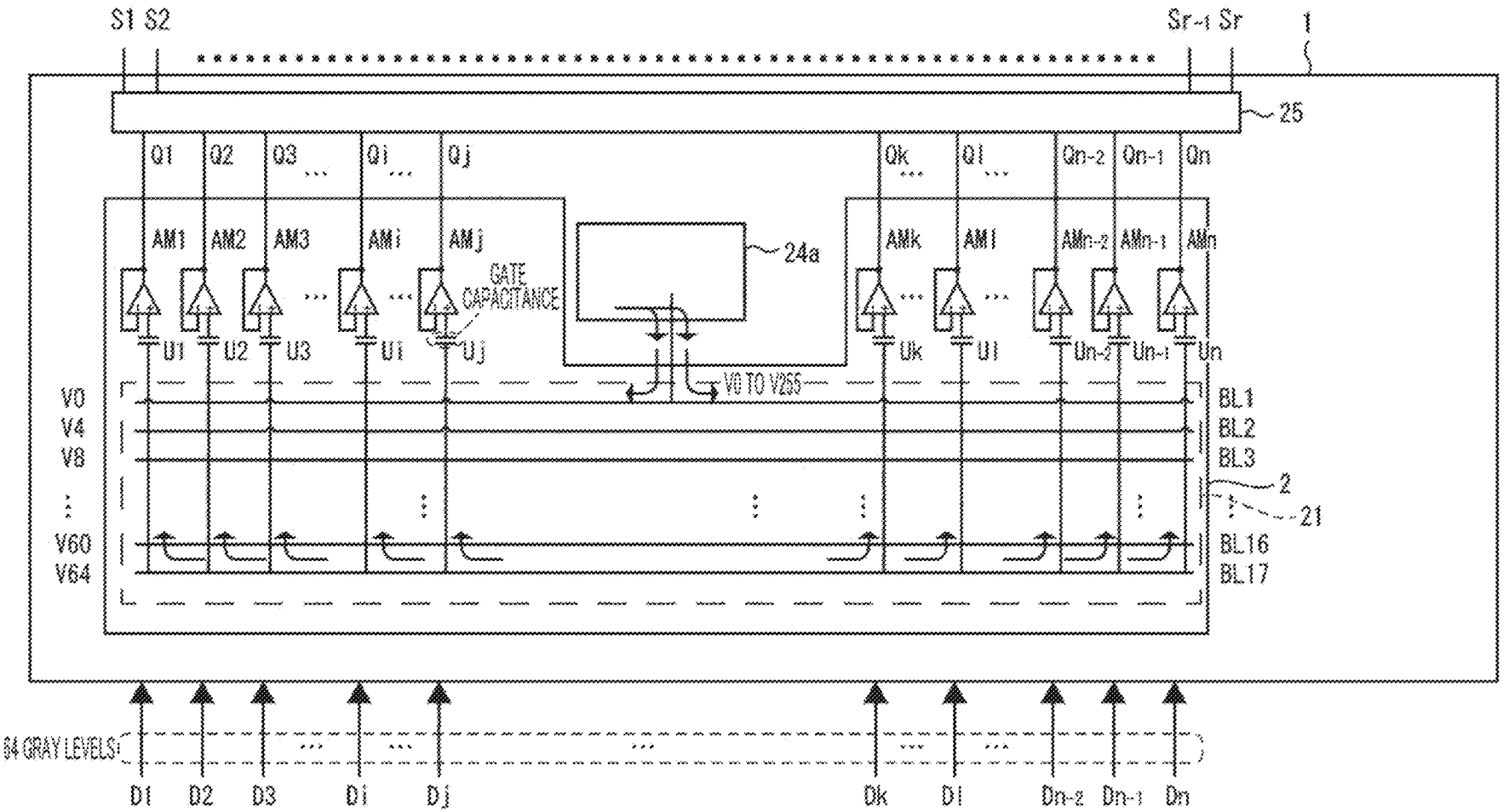
FIG. 2 is a block diagram illustrating a configuration of a source driving circuit in the display device.

As illustrated in FIG. 2, the source driving circuit 1 is provided with a DA converter 2, a gamma circuit 24*a*, and a demultiplexer 25. The source driving circuit drives a plurality of source lines S1, . . . , Sr by time-division multiplexing.

The gamma circuit 24*a* outputs a predetermined number (herein, 17) of gray scale reference voltages V0, V4, V8, . . . , V60, V64. The gamma circuit 24*a* supplies the gray scale reference voltages V0, V4, V8, . . . , V60, V64 to the DA converter 2 through respective reference voltage bus lines BL1 to BL17 (lines).

Note that in the following description of the embodiments, the "gray scale reference voltages" are referred to as "reference voltages" for simplicity.

The DA converter 2 includes a select circuit 21 and a plurality of source amplifiers AM1 to AMn (output circuits). On the basis of each of the gray scale values of input image data D1 to Dn (display data), the select circuit 21 selects one of the reference voltages V0 to V64 supplied by the gamma circuit 24*a*, and outputs the selected reference voltage to each of the source amplifiers AM1 to AMn. The select circuit 21 selects reference voltages Vk (where k is 0 or a multiple of 4) such that when the reference voltages Vk corresponding to the gray scale values of the image D1 to Dn are substantially equal to the output voltages output by the source amplifiers AM1 to AMn, at least one of the selected reference voltages Vk is different from the others.

The source amplifiers AM1 to AMn include a voltage follower circuit. Also, each of the source amplifiers AM1 to AMn includes a plurality of input terminals, and outputs an output voltage corresponding to the gray level output to each of the source lines S1 to Sr, on the basis of the reference voltage Vk from the select circuit 21 input into these input terminals.

In the following description, the source amplifiers AM1 to AMn will be referred to as the source amplifier AM when not being particularly distinguished.

Note that although the source driving circuit 1 is provided with the demultiplexer 25, the demultiplexer 25 does not have to be provided.

Configuration and Operation of Source Amplifier AM

Figure 3:
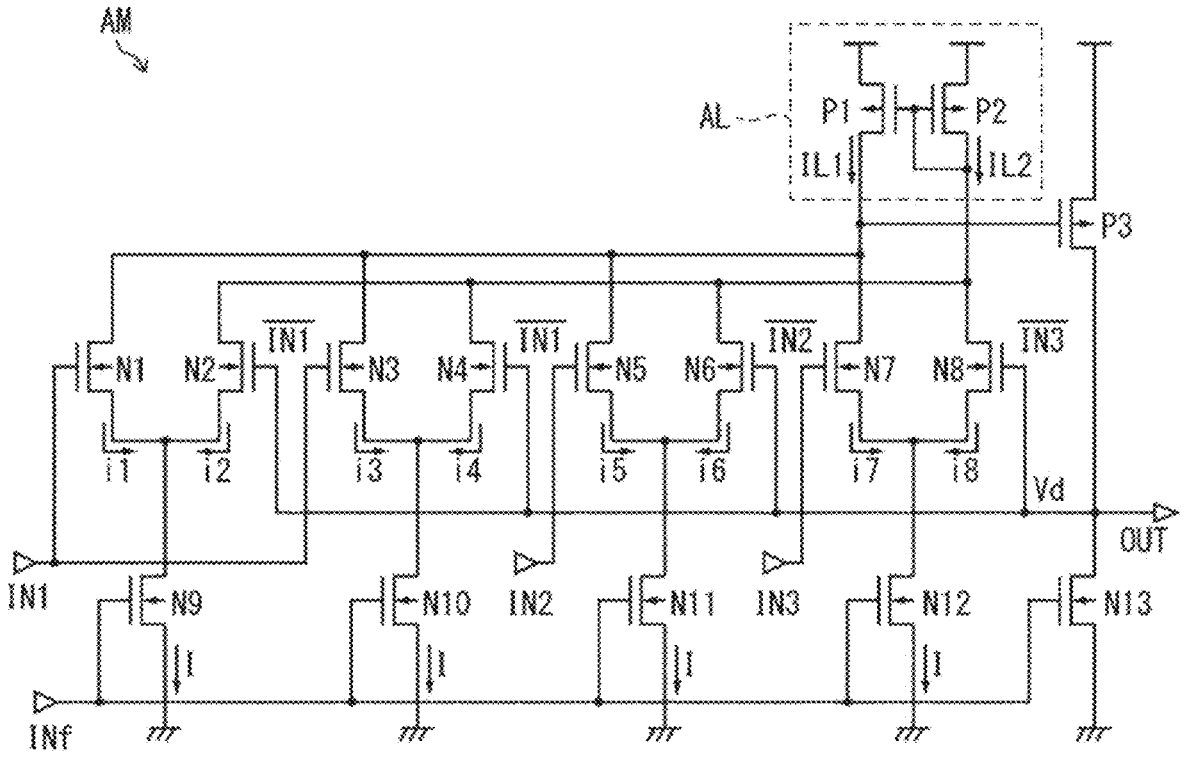
FIG. 3 is a circuit diagram illustrating a configuration of a source amplifier in the source driving circuit.

FIG. 3 is a circuit diagram illustrating a configuration of the source amplifier AM.

As illustrated in FIG. 3, the source amplifier AM includes in-phase input terminals IN1 to IN3 and inverse-phase input terminals /IN1 to /IN3. The input terminal IN1 is two input terminals, but is treated as a singular input terminal. Also, the input terminals /IN1 to /IN3 are interconnected.

Among transistors N1 to N8 (N-channel MOS type), the transistors N1 and N2, the transistors N3 and N4, the transistors N5 and N6, and the transistors N7 and N8 form respective differential pairs. Also, in each differential pair, the sources of each of the transistors forming the differential pair are connected to each other and respectively connected to ground through transistors N9 to N12 (N-channel MOS type) that operate as constant current sources.

The transistors N9 to N12 supply the operating current of each of the differential pairs. A common current flows to the transistors N9 to N12 by an input voltage VINf from an input terminal INf.

The drains of the transistors N1, N3, N5, and N7 are connected to each other and also connected to the drain of a transistor P1 (P-channel MOS type). On the other hand, the drains of the transistors N2, N4, N6, and N8 are connected to each other and also connected to the drain of a transistor P2 (P-channel MOS type).

The transistor P1 and the diode-connected transistor P2 form an active load circuit AL containing a current mirror circuit. Also, the sources of the transistors P1 and P2 are connected to a power source.

An output terminal OUT is formed by a transistor P3 (P-channel MOS type) and a transistor N13 (N-channel MOS type) that operates as a constant current source supplying an operating current to the transistor P3.

The drain of the transistor P3 is connected to ground through the transistor N13, while the source of the transistor P3 is connected to a power source. Also, the gates of the transistors N2, N4, N6, N8 and the drain of the transistor P3 are connected to each other, and are also connected the output terminal OUT. The gate of the transistor P3 is connected to the drain of the transistor P1. Also, the same input voltage VINf as the gates of the transistors N9 to N12 is input into the gate of the transistor N13.

Herein, let I be the current flowing equally through each of the transistors N9 to N13 that operate as constant current sources. Also, the characteristics of the transistors N1 to N8 forming the differential pairs resemble each other, and all have the same transfer conductance am.

Note that by connecting the in-phase input terminals of each of the differential pair of the transistors N1 and N2 and the differential pair of the transistors N3 and N4 to the common input terminal IN1, the reference voltage (input voltage VIN1) input into the input terminal IN1 is weighed double compared to the reference voltages (input voltage VIN2 and input voltage VIN3) input into the input terminal IN2 and the input terminal IN3.

Herein to simplify the description of operations, first, a state in which the transistors P3 and N13 are detached from the source amplifier AM will be described.

Assume that the input voltage VIN1 is input into the input terminal IN1 and a common voltage Vd is input into the input terminal /IN1 (two in common). In this state, a drain current i1 (the same as a drain current i3) of the transistor N1 (the same as the transistor N3) and a drain current i2 (the same as a drain current i4) of the transistor N2 (the same as the transistor N4) are expressed as follows.

$$i1 = i3 = (I/2) + gm(Vd - VIN1) = (I/2) + gm \cdot \Delta va$$

$$i2 = i4 = (I/2) - gm(Vd - VIN1) = (I/2) - gm \cdot \Delta va$$

Herein, let. Δva=Vd−VIN1.

Similarly, assume that the input voltage VIN2 is input into the input terminal IN2 and the common voltage Vd is input into the input terminal /IN2. In this state, a drain current i5 of the transistor N5 and a drain current i6 of the transistor N6 are expressed as follows.

$$i5 = (I/2) + gm(Vd - VIN2) = (I/2) + gm \cdot \Delta vb$$

$$i6 = (I/2) - gm(Vd - VIN2) = (I/2) - gm \cdot \Delta vb$$

Herein, let Δvb=Vd−VIN2.

Similarly, assume that the input voltage VIN3 is input into the input terminal IN3 and the common voltage Vd is input into the input terminal /IN3. In this state, a drain current i7 of the transistor N7 and a drain current i8 of the transistor N8 are expressed as follows.

$$i7 = (I/2) + gm(Vd - VIN3) = (I/2) + gm \cdot \Delta vc$$

$$i8 = (I/2) - gm(Vd - VIN3) = (I/2) - gm \cdot \Delta vc$$

Herein, let Δvc=Vd−VIN3.

From these formulas, a drain current IL1 of the transistor P1 and a drain current IL2 of the transistor P2 are expressed by the following formulas, respectively.

$$IL1 = i1 + i3 + i5 + i7 = 2I + gm(\Delta va + \Delta va + \Delta vb + \Delta vc) \quad (A)$$

$$IL2 = i2 + i4 + i6 + i8 = 2I - gm(\Delta va + \Delta va + \Delta vb + \Delta vc) \quad (B)$$

According to the above formulas (A) and (B), the drain currents IL1 and IL2 are the result of superposing the result of the differential amplification of each of the four differential pairs. Additionally, the transistors P1 and P2 forming the active load circuit AL form a current mirror circuit. With this arrangement, in the operating range in which the amplification circuit performs a normal amplification operation, the two drain currents IL1 and IL2 (load currents) are equal.

Therefore, in the above formulas (A) and (B), setting IL1=IL2 gives the following formula.

$$\Delta va + \Delta va + \Delta vb + \Delta vc = 0$$

$$(Vd - VIN1) + (Vd - VIN1) + (Vd - VIN2) + (Vd - VIN3) = 0 \quad (C)$$

This formula has an effect of extending the relational expression of an imaginary short in a normal op-amp circuit to the source amplifier AM. Note that this relationship presupposes that the differential amplifier circuit in the source amplifier AM is set to operate in a predetermined appropriate bias state, and is in a normal differential amplification range that amplifies a small-amplitude signal near the operating point.

Therefore, the following formula is derived from the above formula (C).

$$Vd = (VIN1 \times 2 + VIN2 + VIN3)/4$$

The above formula indicates that the common voltage Vd input into the common input terminals /IN1 to /IN3 is given the average value of input voltages into the three input terminals IN1, IN2, and IN3 while doubling the weighting of the input voltage of the input terminal IN1.

Additionally, the source amplifier AM returns the output signal of the differential amplifier circuit itself to the input terminals /IN1, /IN2, and /IN3 shared by the differential amplifier circuit. Therefore, the output voltage Vout of the source amplifier AM is expressed by the following formula.

$$Vout=(VIN1\times2+VIN2+VIN3)/4 \quad (D)$$

The formula (D) indicates taking the average value of the three input voltages VIN1, VIN2, and VIN3 while doubling the weighting of one of the input voltages of the three input terminals IN1, IN2, and IN3.

Embodiment 1

Embodiment 1 of the present disclosure is described below with reference to FIGS. 2 to 4. Note that for the sake of convenience, structural elements having the same function as structural elements in the description of the "display device" described above are denoted with the same signs, and further description is omitted.

FIGS. 4A to 4D are diagrams illustrating combinations of reference voltages input into the source amplifier AM according to the present embodiment.

In the present embodiment, as illustrated in FIG. 3, the source amplifier AM including three input terminals IN1, IN2, and IN3 is used. Also, in the case of creating voltages (V0 to V7) for 8 gray levels based on the reference voltages V0, V4, and V8 (V0<V4<V8), the case of outputting output voltages Vout4 to Vout7 satisfying the relationship Vout4 (=V4)<Vout5<Vout6<Vout7<Vout8 (=V8) between the reference voltages V4 and V8 will be described.

As described above, the input terminal IN1 is weighted double compared to the input terminals IN2 and IN3. In FIGS. 4A to 4D, for the sake of convenience, the input terminal IN1 is represented as two single-weighted terminals.

Figure 4A:
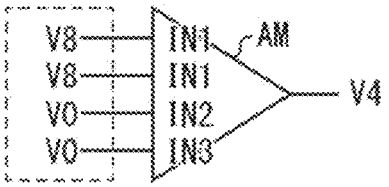
FIGS. 4A to 4D are diagrams illustrating combinations of gray scale reference voltages input into the source amplifier according to Embodiment 1 of the present disclosure.

In the case where the source amplifier AM outputs the output voltage Vout4 as the output voltage Vout, the select circuit 21 illustrated in FIG. 2 selects the reference voltages V to output to the input terminals IN1 to IN3 such that the average of V8×2+V0×2 illustrated in FIG. 4A is output.

Figure 4B:
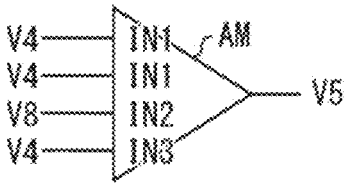

In the case where the source amplifier AM outputs the output voltage Vout5 as the output voltage Vout, the select circuit 21 selects the reference voltages V to output to the input terminals IN1 to IN3 such that the average of V4×3+V8×1 illustrated in FIG. 4B is output.

Figure 4C:
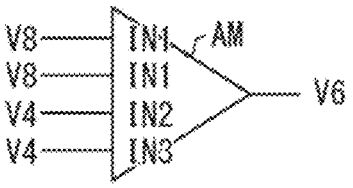

In the case where the source amplifier AM outputs the output voltage Vout6 as the output voltage Vout, the select circuit 21 selects the reference voltages V to output to the input terminals IN1 to IN3 such that the average of V4×2+V8×2 illustrated in FIG. 4C is output.

Figure 4D:
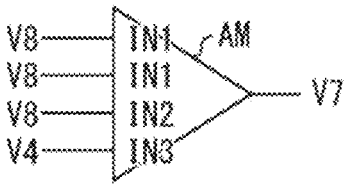

In the case where the source amplifier AM outputs the output voltage Vout7 as the output voltage Vout, the select circuit 21 selects the reference voltages V to output to the input terminals IN1 to IN3 such that the average of V4×1+V8×3 illustrated in FIG. 4D is output.

With this arrangement, a maximum of three reference voltages V4 are input into the input terminals IN1 to IN3 of the source amplifier AM. In the case where the reference voltage V4 is input into the input terminals IN1 to IN3 of the source amplifier AM, a minimum of one reference voltage V4 is input. However, in this case, a maximum of three reference voltages V8 are input. In the case where two varieties of reference voltages are input into the input terminals IN1 to IN3 of the source amplifier AM, the gate capacitance connected to the reference voltage bus line of the reference voltage with the larger maximum number of reference voltages input into the input terminals IN1 to IN3 from among the selected reference voltages increases, and therefore the influence on the settling time increases. For example, in the case of displaying a gray scale value "7", the select circuit 21 selects the reference voltages V4×1 and V8×3. In this case, the settling time is more greatly influenced by V8, a maximum of three of which are input into the input terminals IN1 to IN3. Considering the cases where the reference voltages V4 and V8 are input into the input terminals IN1 to IN3, the settling time is the shortest in the case of V4×2 and V8×2, and the settling time is the longest in the case of V4×3 and V8×1 or the case of V4×1 and V8×3. Accordingly, inconsistencies in the settling time of the source amplifier AM can be reduced.

Figure 14A:
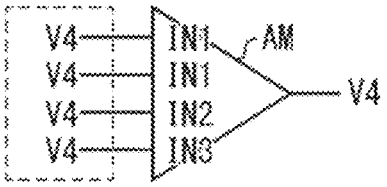
FIGS. 14A to 14D are diagrams illustrating combinations of gray scale reference voltages input into a source amplifier of the related art.
Figure 14B:
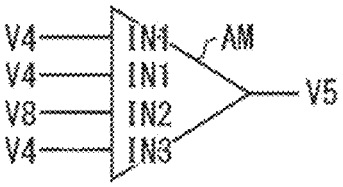
Figure 14C:
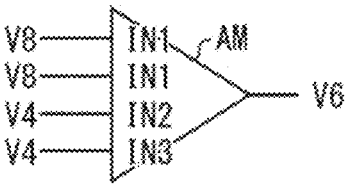
Figure 14D:
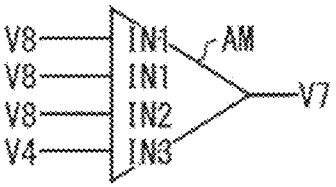

In contrast, with a source amplifier AM of the related art, in the case of outputting the output voltage Vout4 as the output voltage Vout, the reference voltage V4 is input into all of the input terminals IN1 to IN3 (see FIG. 14A). For this reason, as described earlier, the gate capacitances of each of the input transistors in the input terminals IN1 to IN3 of the source amplifier AM are all connected to the reference voltage bus line that outputs the reference voltage V4. In other words, the settling time is the shortest in the case of V4×2 and V8×2, the settling time is the longest in the case of V4×4 or V8×4, and the settling time is intermediate in the case of V4×3 and V8×1 or the case of V4×1 and V8×3. Consequently, the settling time of the output voltage of the source amplifier AM is longer and more inconsistent.

Embodiment 2

Embodiment 2 of the present disclosure is described below with reference to FIGS. 5 and 6. Note that for the sake of convenience, structural elements having the same function as structural elements in the description of the "display device" and Embodiment 1 are denoted with the same signs, and further description is omitted.

Figure 5:
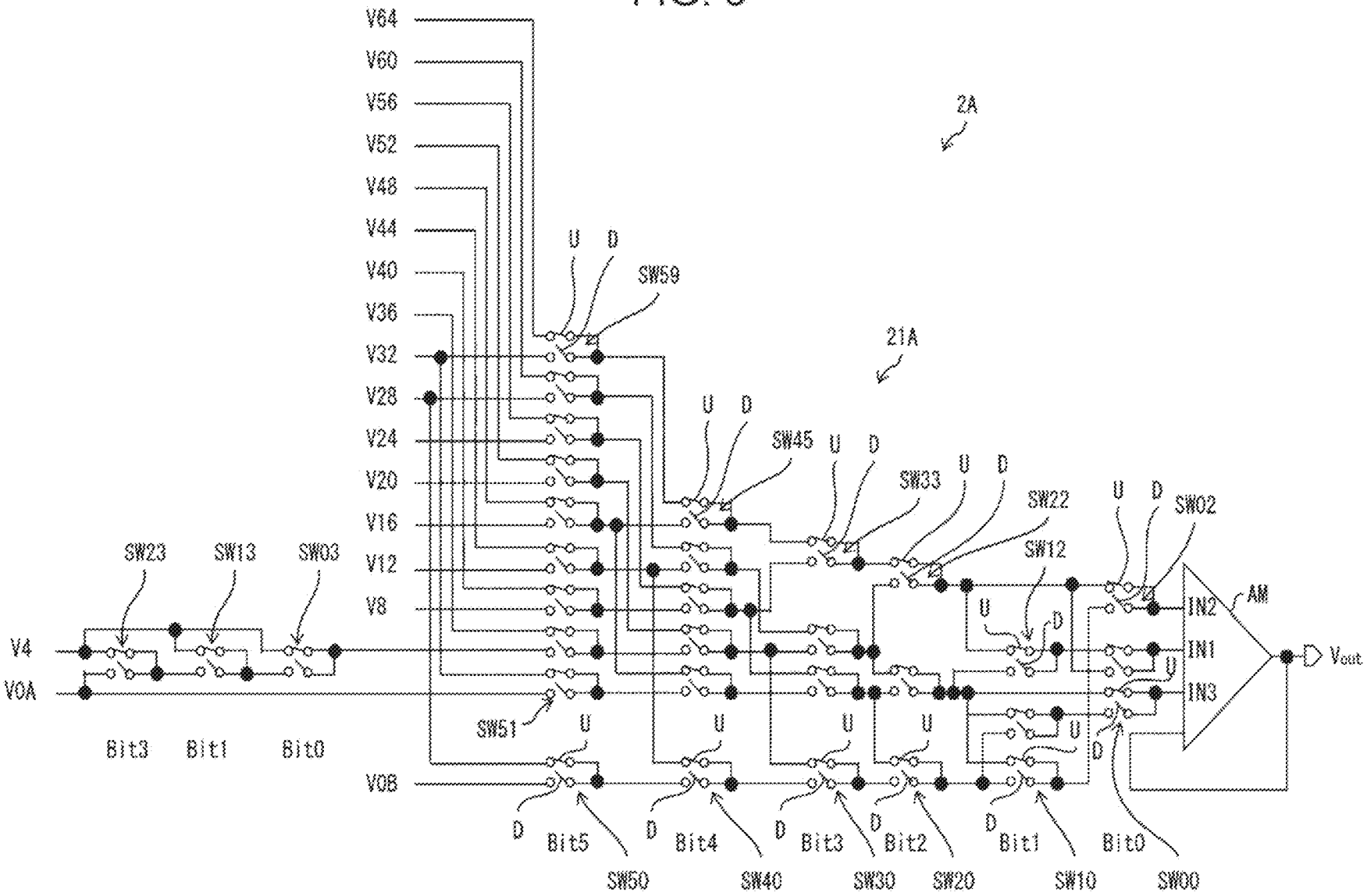
FIG. 5 is a circuit diagram illustrating a configuration of a DA converter in the source driving circuit according to Embodiment 2 of the present disclosure.

FIG. 5 is a circuit diagram illustrating a configuration of a DA converter 2A according to the present embodiment. FIG. 6 is a table illustrating relationships of a gray scale value, display data, input terminals of the source amplifier, and an output voltage of the DA converter 2A with regard to a digital-to-analog conversion performed by the DA converter.

As illustrated in FIG. 5, the present embodiment describes the DA converter 2A as a specific example of the DA converter 2 illustrated in FIG. 2.

The DA converter 2A converts 6-bit display data into the output voltage Vout corresponding to a gray level. The DA converter 2A is provided with a select circuit 21A and a source amplifier AM.

The select circuit 21A selects three from among reference voltages V0A, V0B, V4, V8, V12, V16, V20, V24, V28, V32, V36, V40, V44, V48, V52, V56, V60, and V64, and outputs the selected reference voltages to the source amplifier AM. For this reason, the select circuit 21A includes switches SW00 to SW03, SW10 to SW13, SW20 to SW23, SW30 to SW33, SW40 to SW45, and SW50 to SW59.

Herein, because there are not reference voltages lower than the reference voltage V0, the two reference voltages V0A and V0B are provided as voltages equal to the reference voltage V0. This is to make the parasitic resistance and the parasitic capacitance approximately ½ that of the other reference voltages V4, V8, . . . , V64. It is not strictly necessary to provide the two reference voltages V0A and V0B.

Note that in the following description, the switches SW00 to SW03, SW10 to SW13, SW20 to SW23, SW30 to SW33, SW40 to SW45, and SW50 to SW59 are referred to as the switches SW when not being particularly distinguished.

Each switch SW contains two open/close switches, and as illustrated in FIG. 5, the one positioned higher is labeled "U" while the one positioned lower is labeled "D". The ends on the source amplifier AM side of the switches SWU and SWD are connected to each other.

When the value of each bit of the display data is "0", the switch SWD is on (closed) and the switch SW00U is off (open). When the value of each bit is "1", the switch SWD is off and the switch SWU is on. The switches SW00 to SW03 turn on and off according to a least-significant Bit0. The switches SW10 to SW13 turn on and off according to a second-least-significant Bit1. The switches SW20 to SW23 turn on and off according to a third-least-significant Bit2. The switches SW30 to SW33 turn on and off according to a fourth-least-significant Bit3. The switches SW40 to SW45 turn on and off according to a fifth-least-significant Bit4. The switches SW50 to SW59 turn on and off according to a most-significant Bit5.

One end of the switches SW00D and SW00U is connected to the input terminal IN3 of the source amplifier AM. One end of the switches SW01D and SW01U is connected to the input terminal IN1 of the source amplifier AM. One end of the switches SW02D and SW02U is connected to the input terminal IN2 of the source amplifier AM.

One end of the switches SW10D and SW10U is connected to the other end of the switch SW02D. One end of the switches SW11D and SW11U is connected to the other end of the switch SW00D. One end of the switches SW12D and SW12U is connected to the other end of the switch SW01U.

One end of the switches SW20D and SW20U is connected to the other end of the switches SW10D and SW11D. One end of the switches SW21D and SW21U is connected to the other end of the switches SW10U, SW11U, SW00U, and SW12D. One end of the switches SW22D and SW22U is connected to the other end of the switches SW12U and SW02U.

One end of the switches SW30D and SW30U is connected to the other end of the switch SW20D. One end of the switches SW31D and SW31U is connected to the other end of the switches SW20U and SW21D. One end of the switches SW32D and SW32U is connected to the other end of the switches SW21U and SW22D. One end of the switches SW33D and SW33U is connected to the other end of the switch SW22U.

One end of the switches SW40D and SW40U is connected to the other end of the switch SW30D. One end of the switches SW41D and SW41U is connected to the other end of the switch SW31D. One end of the switches SW42D and SW42U is connected to the other end of the switches SW30U and SW32D. One end of the switches SW43D and SW43U is connected to the other end of the switches SW31U and SW33D. One end of the switches SW44D and SW44U is connected to the other end of the switch SW32U. One end of the switches SW45D and SW45U is connected to the other end of the switch SW33U.

One end of the switches SW50D and SW50U is connected to the other end of the switch SW40D. One end of the switches SW51D and SW51U is connected to the other end of the switch SW41D. One end of the switches SW52D and SW52U is connected to the other end of the switch SW42D. One end of the switches SW53D and SW53U is connected to the other end of the switch SW43D. One end of the switches SW54D and SW54U is connected to the other end of the switches SW40U and SW44D. One end of the switches SW55D and SW55U is connected to the other end of the switches SW41U and SW45D.

One end of the switches SW56D and SW56U is connected to the other end of the switch SW42U. One end of the switches SW57D and SW57U is connected to the other end of the switch SW43U. One end of the switches SW58D and SW58U is connected to the other end of the switch SW44U. One end of the switches SW59D and SW59U is connected to the other end of the switch SW45U.

The reference voltage V0B is input into the other end of the switch SW50D, and the reference voltage V28 is input into the other end of the switch SW50U. The reference voltage V0A is input into the other end of the switch SW51D, and the reference voltage V32 is input into the other end of the switch SW51U. The reference voltage V36 is input into the other end of the switch SW52U. The reference voltage V8 is input into the other end of the switch SW53D, and the reference voltage V40 is input into the other end of the switch SW53U. The reference voltage V12 is input into the other end of the switch SW54D, and the reference voltage V44 is input into the other end of the switch SW54U. The reference voltage V16 is input into the other end of the switch SW55D, and the reference voltage V48 is input into the other end of the switch SW55U.

The reference voltage V20 is input into the other end of the switch SW56D, and the reference voltage V52 is input into the other end of the switch SW56U. The reference voltage V24 is input into the other end of the switch SW57D, and the reference voltage V56 is input into the other end of the switch SW57U. The reference voltage V28 is input into the other end of the switch SW58D, and the reference voltage V60 is input into the other end of the switch SW58U. The reference voltage V32 is input into the other end of the switch SW59D, and the reference voltage V64 is input into the other end of the switch SW59U.

One end of the switches SW03D and SW03U is connected to the other end of the switch SW52D. One end of the switches SW13D and SW13U is connected to the other end of the switch SW03D. One end of the switches SW23D and SW23U is connected to the other end of the switch SW13D. The reference voltage V0A is input into the other end of the switch SW23D. The reference voltage V4 is input into the other end of the switches SW03U, SW13U, and SW23U.

When the reference voltage Vm (where m is a natural number equal to or greater than 4) corresponding to a selected gray scale value is equal to (or substantially equal to) the output voltage Vout, the DA converter 2A configured as above selects two reference voltages Vm−4 and Vm+4 adjacent to the reference voltage Vm. For example, in the case of displaying the gray scale value "8", instead of selecting the reference voltage V8, the select circuit 21A selects the reference values V4 and V12 adjacent to the reference voltage V8. Herein, in the case of displaying the gray scale value "0", because the reference voltage Vm−4 (m=0) does not exist, the select circuit 21A selects the reference voltages V0A and V0B.

With this arrangement, a maximum of three, including weighing, of the reference voltages V4, V8, . . . , V60 are input into the input terminals IN1 to IN3 of the source amplifier AM. Consequently, inconsistencies in the settling time of the output voltage Vout of the source amplifier AM can be reduced.

In contrast, in the DA converter of the related art illustrated in FIG. 13, when the reference voltage Vm corresponding to the gray scale value to be displayed is equal to the output voltage Vout, the reference voltage Vm is selected. For this reason, as described above, a maximum of four, including weighting, of the reference voltages V4, V8, . . . , V60 are input into the input terminals IN1 to IN3 of the source amplifier AM. For this reason, inconsistencies in the settling time of the output voltage Vout of the source amplifier AM are doubled compared to the present embodiment.

Also, the DA converter 2A is provided with the two reference voltages V0A and V0B for the same voltage. With this arrangement, the gate capacitances of the input transistors of the source amplifier AM connected to the same reference voltage bus line can be halved.

Embodiment 3

Embodiment 3 of the present disclosure is described below with reference to FIGS. 7 to 9. Note that for the sake of convenience, structural elements having the same function as structural elements in the description of the "display device" and Embodiments 1 and 2 are denoted with the same signs, and further description is omitted.

Figure 7:
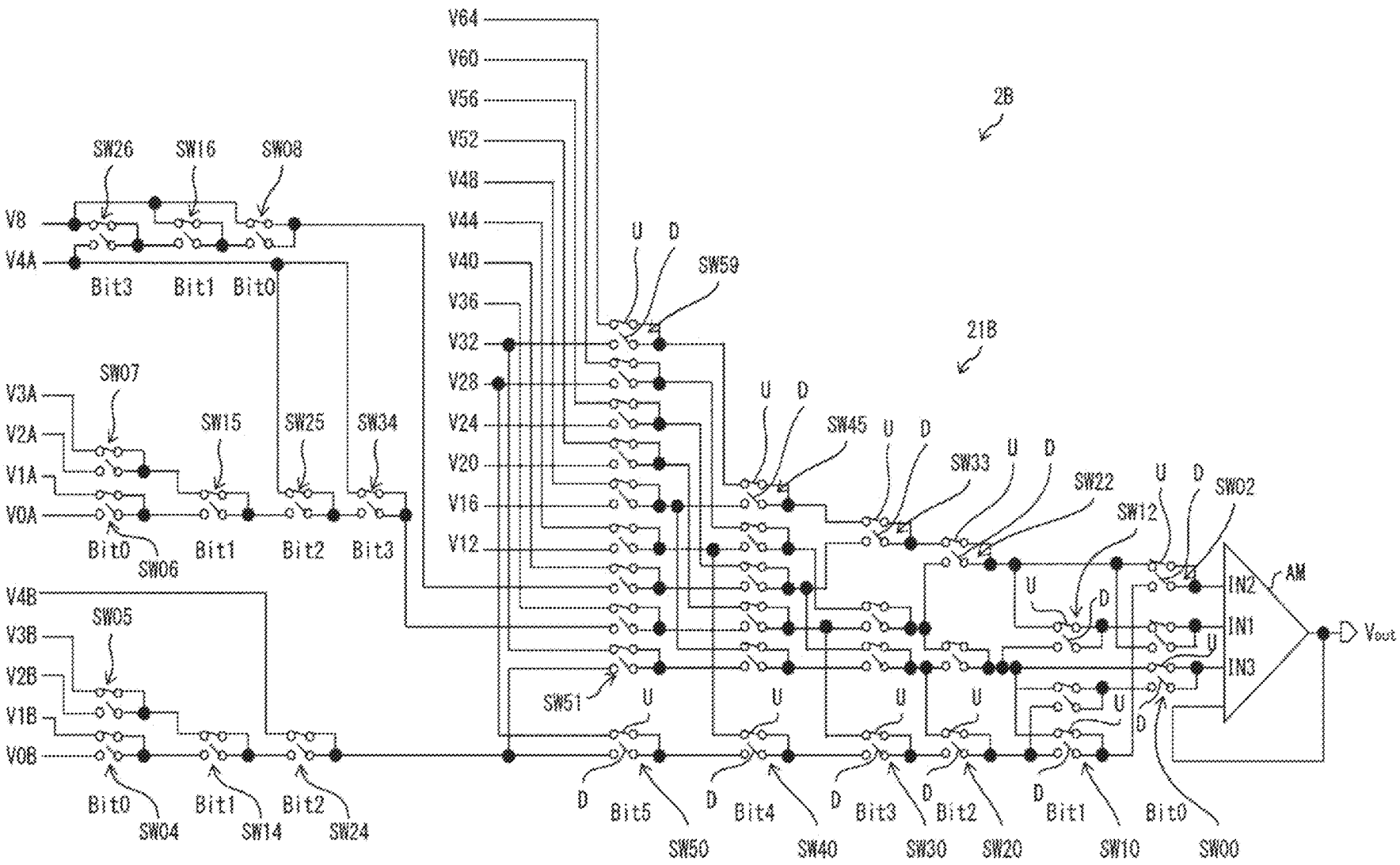
FIG. 7 is a circuit diagram illustrating a configuration of a DA converter in the source driving circuit according to Embodiment 3 of the present disclosure.
Figure 10A:
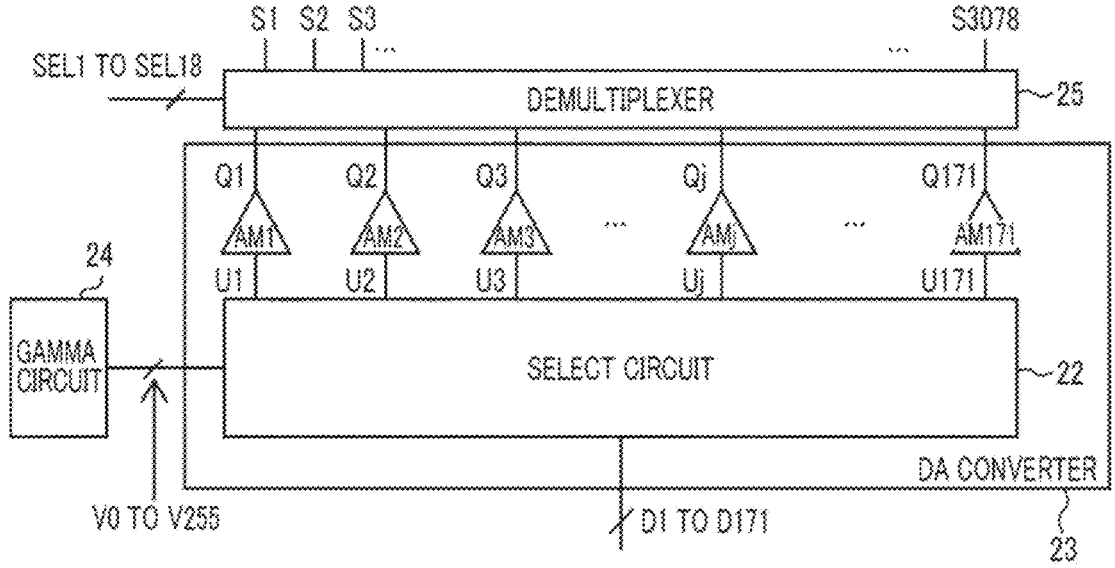
FIG. 10A is a block diagram illustrating a source driving circuit of the related art.
Figure 10B:
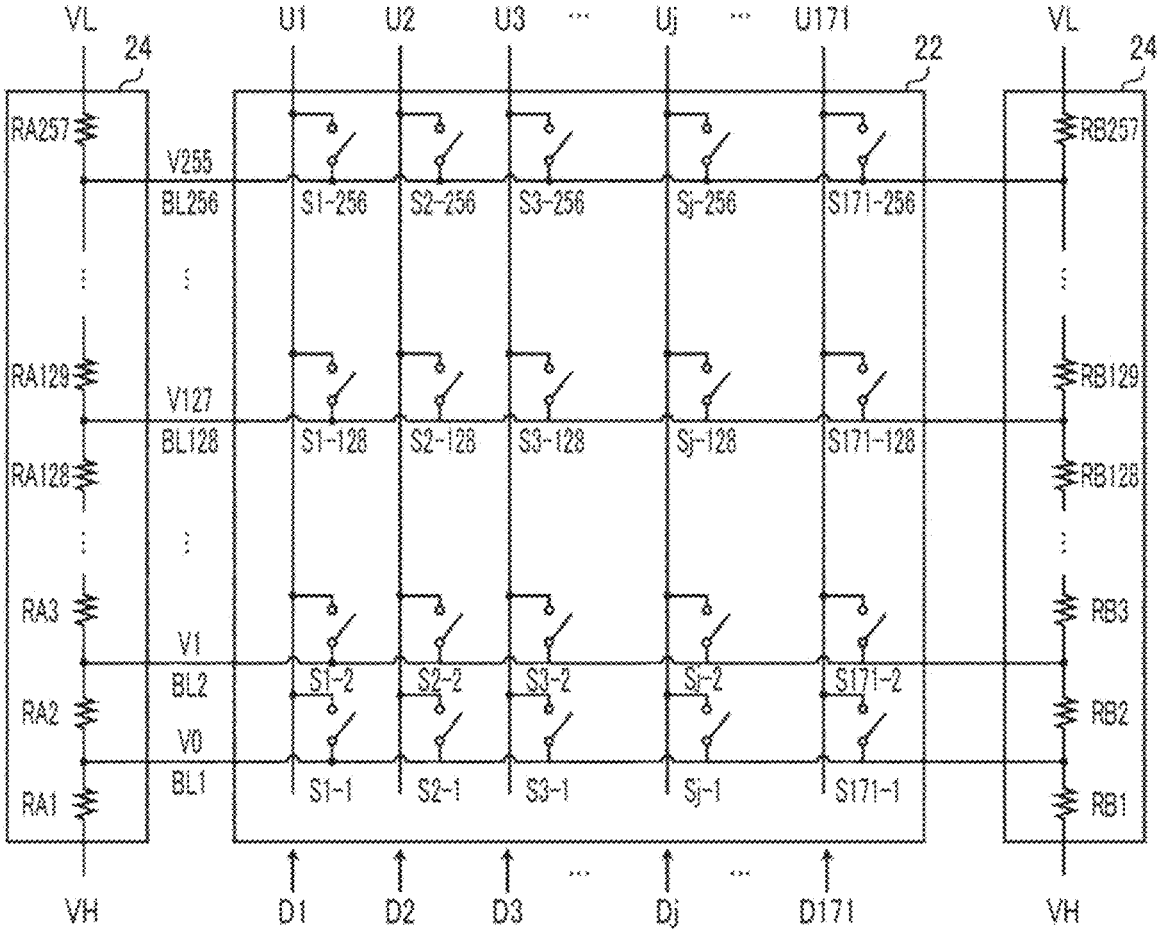
FIG. 10B is a circuit diagram illustrating a configuration of a select circuit and a gamma circuit in the source driving circuit.
Figure 11A:
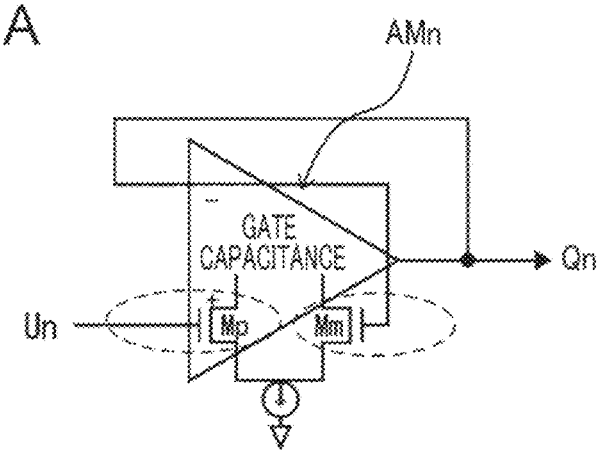
FIGS. 11A to 11C are diagrams for explaining a problem with the source driving circuit of the related art illustrated in FIG. 10A.
Figure 11B:
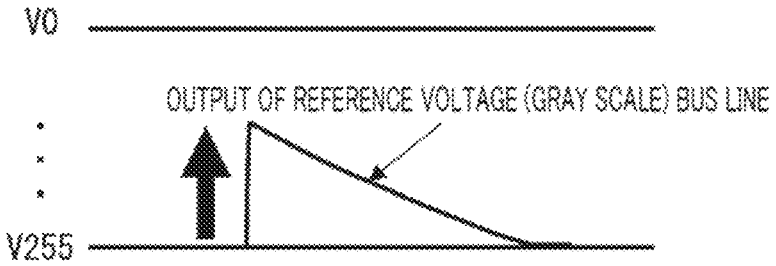
Figure 11C:
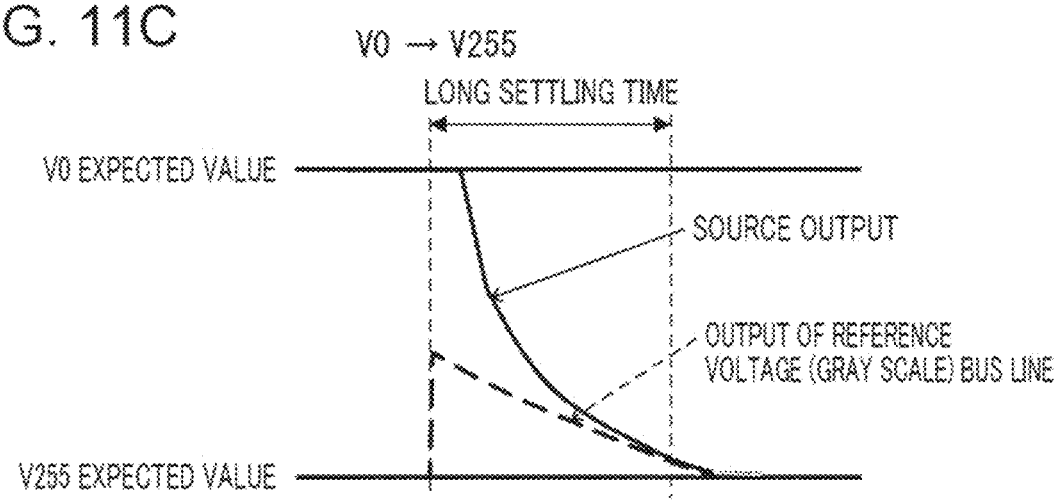
Figure 12:
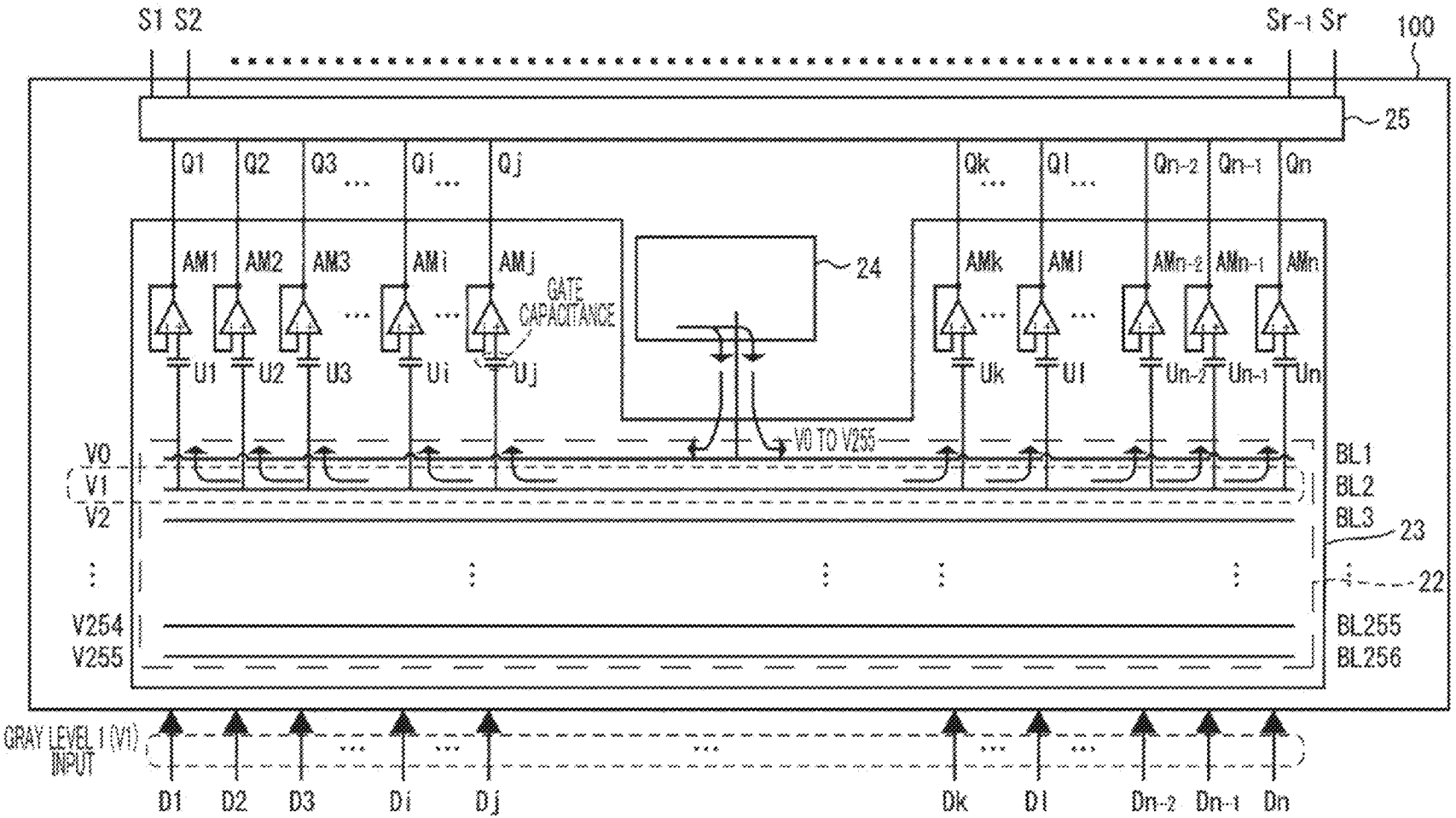
FIG. 12 is a block diagram illustrating a more detailed configuration of the source driving circuit illustrated in FIG. 10A.

FIG. 7 is a circuit diagram illustrating a configuration of a DA converter 2B according to the present embodiment. FIG. 8 is a table illustrating relationships of a gray scale value, display data, input terminals of the source amplifier, and an output voltage of the DA converter 2B with regard to a digital-to-analog conversion performed by the DA converter 2. FIG. 9 is a table illustrating relationships of a gray scale value, display data, input terminals of the source amplifier, and an output voltage of a DA converter with regard to a digital-to-analog conversion performed by a DA converter according to a comparative example.

As illustrated in FIG. 7, the present embodiment describes the DA converter 2B as a specific example of the DA converter 2 illustrated in FIG. 2.

The DA converter 2B is provided with a select circuit 21B and a source amplifier AM. The DA converter 2B converts 6-bit display data into the output voltage Vout corresponding to a gray level.

Like the DA converter 2A of Embodiment 2, the select circuit 21B includes switches SW00 to SW02, SW10 to SW12, SW20 to SW22, SW30 to SW33, SW40 to SW45, and SW50 to SW59. Also, instead of the switches SW03, SW13, and SW23 of the DA converter 2A, the select circuit 21B includes switches SW04 to SW08, SW14 to SW16, SW24 to SW26, and SW34.

Herein, like the reference voltages V0A and V0B of Embodiment 2, for the DA converter 2B, reference voltages V0A and V0B, reference voltages V1A and V1B, reference voltages V2A and V2B, reference voltages V3A and V3B, and reference voltages V4A and V4B are provided two at a time as voltages equal to the reference voltages V0 to V4, respectively.

One end of the switch SW34 is connected to the other end of the switch SW52D. One end of the switch SW24 is connected to the other end of the switch SW50D. One end of the switch SW25 is connected to the other end of the switch SW34D. One end of the switch SW08 is connected to the other end of the switch SW53D.

One end of the switch SW14 is connected to the other end of the switch SW24D. One end of the switch SW15 is connected to the other end of the switch SW25D. One end of the switch SW16 is connected to the other end of the switch SW08D.

One end of the switch SW04 is connected to the other end of the switch SW14D. One end of the switch SW05 is connected to the other end of the switch SW14U. One end of the switch SW06 is connected to the other end of the switch SW15D. One end of the switch SW07 is connected to the other end of the switch SW15U. One end of the switch SW26 is connected to the other end of the switch SW16D.

The reference voltage V0B is input into the other end of the switch SW04D, and the reference voltage V1B is input into the other end of the switch SW04U. The reference voltage V2B is input into the other end of the switch SW05D, and the reference voltage V3B is input into the other end of the switch SW05U. The reference voltage V4B is input into the other end of the switch SW24U.

The reference voltage V0A is input into the other end of the switch SW06D, and the reference voltage V1A is input into the other end of the switch SW06U. The reference voltage V2A is input into the other end of the switch SW07D, and the reference voltage V3A is input into the other end of the switch SW07U.

The reference voltage V4A is input into the other end of the switches SW26D, SW34U, and SW25U. The reference voltage V8 is input into the other end of the switches SW26U, SW16U, and SW08U.

In the case where the difference between adjacent reference voltages V is large, if the output voltage Vout is output by weighting the input terminals IN1 to IN3, the offset produced in the output voltage Vout tends to increase. For example, as illustrated in FIG. 13 as a comparative example, when the DA converter of the related art outputs the output voltage Vout for a gray scale value, particularly in the case of large differences between the reference voltages V0 and V1, between the reference voltages V1 and V2, between the reference voltages V2 and V3, and between the reference voltages V3 and V4, the offset increases easily when the reference voltages V1, V2, and V3 are selected.

To deal with the above, in the DA converter of the related art, it may be necessary to provide a countermeasure by providing a reference voltage individually for the relevant reference voltages V1, V2, and V3 as illustrated in FIG. 9 with respect to the portion of reference voltages V0 to V4 having a large difference between the reference voltages V. With this arrangement, the number of reference voltages increases, but the offset of the output voltage Vout can be reduced. However, a maximum of four, including weighting, of the reference voltages V0 to V4 are input into the input terminals IN1 to IN3 of the source amplifier AM. In contrast, in the DA converter 2B configured as described above, the relevant reference voltages V0A, V0B, V1A, V1B, V2A, V2B, V3A, V3B, V4A, and V4B are provided as illustrated in FIG. 8 with respect to the portion of reference voltages V0 to V4 having a large difference between reference voltages V. Additionally, as illustrated in FIG. 7, in the DA converter 2B, reference voltage bus lines EL are provided individually for the power source that outputs the reference voltages V0A, V0B, V1A, V1B, V2A, V2B, V3A, V3B, V4A, and V4B.

With this arrangement, the offset of the output voltage Vout can be reduced. In particular, by providing two lines each for some or all of the reference voltage bus lines BL for the reference voltage with the increased offset above, a distribution of load may be attained. Consequently, the parasitic capacitance can be reduced. For example, there is also a method of attaining a distribution of load by providing two groups by amplifier, such as the source amplifiers AM1, AM3, . . . , AMn-3, AMn-1 and the source amplifiers AM2, AM4, . . . , AMn-2, AMn. However, with this method, the parasitic capacitance and the parasitic resistance are susceptible to manufacturing inconsistencies, and inconsistencies occur in the settling time of the output voltage Vout of the source amplifier AM. With this arrangement, the display device has a problem in that there is a possibility that a visually perceivable difference may occur at the boundary between the two groups. In contrast, in Embodiment 3, because all of the source amplifiers AM are connected to the same reference voltage bus lines EL, the above problem can be avoided.

Additional Notes

The present disclosure is not limited to the embodiments discussed above, and various modifications are possible within the scope indicated by the claims. Embodiments obtained by appropriately combining the technical means respectively disclosed in different embodiments are also included within the technical scope of the present disclosure. Furthermore, new technical features may be formed by combining the technical means respectively disclosed in each of the embodiments.

The present disclosure contains subject matter related to that disclosed in U.S. Provisional Patent Application No. 62/792,715 filed in the US Patent Office on Jan. 15, 2019, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A driving circuit comprising:

a select circuit that selects a predetermined number of gray scale reference voltages from a plurality of different gray scale reference voltages on a basis of display data corresponding to a plurality of different gray scale values; and an output circuit that outputs an output voltage corresponding to the gray scale values on a basis of the gray scale reference voltages selected by the select circuit, wherein when values of the gray scale reference voltages corresponding to the selected gray scale values correspond to a value of the output voltage, the select circuit selects the gray scale reference voltages such that at least one of the gray scale reference voltages to be selected is different from the others.

2. The driving circuit according to claim 1, wherein when the gray scale reference voltages corresponding to the selected gray scale values are equal to the output voltage, the select circuit selects two adjacent gray scale reference voltages as the gray scale reference voltages.

3. The driving circuit according to claim 1, wherein the output circuit includes a plurality of first input terminals that apply weighting to respectively input gray scale reference voltages, the select circuit includes a plurality of second input terminals to which the gray scale reference voltages respectively, and for some of the gray scale reference voltages, a plurality of a same voltage is plurally provided and input into the second input terminals of the select circuit through individual reference voltage bus lines.

4. A display device comprising:

the driving circuit according to claim 1; and a display panel driven by the driving circuit.

5. The driving circuit according to claim 1, wherein the gray scale reference voltages include a first voltage and a second voltage different from the first voltage, the gray scale values include a first value associated with the first voltage, a second value associated with the second voltage, and a third value associated with none of the gray scale reference voltages, and when the output circuit outputs a first output voltage corresponding to the first value, the select circuit selects a first set of voltages from the gray scale reference voltages including the second voltage and excepting for the first voltage, and when the output circuit outputs a second output voltage corresponding to the third value, the select circuit selects a second set of voltages from the gray scale reference voltages including the first voltage and the second voltage.

* * * * *